US009767789B2

(12) United States Patent
Radebaugh

(10) Patent No.: US 9,767,789 B2
(45) Date of Patent: Sep. 19, 2017

(54) USING EMOTICONS FOR CONTEXTUAL TEXT-TO-SPEECH EXPRESSIVITY

(75) Inventor: Carey Radebaugh, Brookline, MA (US)

(73) Assignee: Nuance Communications, Inc., Burlington, MA (US)

( * ) Notice: Subject to any disclaimer, the term of this patent is extended or adjusted under 35 U.S.C. 154(b) by 246 days.

(21) Appl. No.: 13/597,372

(22) Filed: Aug. 29, 2012

(65) Prior Publication Data

US 2014/0067397 A1 Mar. 6, 2014

(51) Int. Cl.
*G10L 13/08* (2013.01)

(52) U.S. Cl.
CPC ..... *G10L 13/08* (2013.01); *G10L 2013/083* (2013.01)

(58) Field of Classification Search
CPC ..... G10L 13/10; G10L 13/08; G10L 13/02
USPC ..... 704/260
See application file for complete search history.

(56) References Cited

U.S. PATENT DOCUMENTS 6,963,839 B1 * 11/2005 Ostermann ..... G10L 13/08 704/2
6,990,452 B1 * 1/2006 Ostermann ..... G10L 13/00 345/473
7,089,504 B1 8/2006 Froloff
7,360,151 B1 4/2008 Froloff
7,434,176 B1 10/2008 Froloff
7,720,784 B1 * 5/2010 Froloff ..... 706/47
7,908,554 B1 * 3/2011 Blattner ..... 715/706
8,855,798 B2 * 10/2014 DiMaria et al. ..... 700/94
2003/0137515 A1 * 7/2003 Cederwall et al. ..... 345/473
2004/0221224 A1 * 11/2004 Blattner et al. ..... 715/500.1
2005/0144002 A1 * 6/2005 Ps ..... 704/266
2006/0009978 A1 * 1/2006 Ma et al. ..... 704/266
2007/0011012 A1 * 1/2007 Yurick ..... G10L 15/26 704/277
2008/0040227 A1 * 2/2008 Ostermann et al. ..... 705/14
2008/0059570 A1 * 3/2008 Bill ..... G06Q 10/10 709/203
2008/0096533 A1 * 4/2008 Manfredi et al. ..... 455/412.1
2008/0109391 A1 * 5/2008 Chan ..... 706/45
(Continued)

OTHER PUBLICATIONS

Walt Froloff, "Irrational Intelligence", 2008, Patentalchemy Press, Amazon.com, www.
http://feelingsintel.com/gamemodel.html.

*Primary Examiner* — Jakieda Jackson
(74) *Attorney, Agent, or Firm* — Banner & Witcoff, Ltd.

(57) ABSTRACT

Techniques disclosed herein include systems and methods that improve audible emotional characteristics used when synthesizing speech from a text source. Systems and methods herein use emoticons identified from a source text to provide contextual text-to-speech expressivity. In general, techniques herein analyze text and identify emoticons included within the text. The source text is then tagged with corresponding mood indicators. For example, if the system identifies an emoticon at the end of a sentence, then the system can infer that this sentence has a specific tone or mood associated with it. Depending on whether the emoticon is a smiley face, angry face, sad face, laughing face, etc., the system can infer use or mood from the various emoticons and then change or modify the expressivity of the TTS output such as by changing intonation, prosody, speed, pauses, and other expressivity characteristics.

20 Claims, 5 Drawing Sheets

(56) References Cited

U.S. PATENT DOCUMENTS

| | | | | |
|---|---|---|---|---|
| 2008/0280633 | A1* | 11/2008 | Agiv | 455/466 |
| 2008/0294443 | A1* | 11/2008 | Eide | 704/260 |
| 2009/0019117 | A1* | 1/2009 | Bonforte et al. | 709/206 |
| 2010/0114579 | A1* | 5/2010 | Ostermann et al. | 704/260 |
| 2010/0182325 | A1* | 7/2010 | Cederwall et al. | 345/473 |
| 2010/0332224 | A1* | 12/2010 | Makela | G10L 13/00 704/231 |
| 2011/0040155 | A1* | 2/2011 | Guzak | G06F 3/0484 600/300 |
| 2011/0112821 | A1* | 5/2011 | Basso et al. | 704/2 |
| 2011/0148916 | A1* | 6/2011 | Blattner | G06Q 10/107 345/619 |
| 2011/0294525 | A1* | 12/2011 | Jonsson | G06F 17/24 455/466 |
| 2012/0001921 | A1* | 1/2012 | Escher et al. | 345/467 |
| 2012/0095976 | A1* | 4/2012 | Hebenthal | G06F 17/30867 707/706 |
| 2012/0130717 | A1* | 5/2012 | Xu et al. | 704/258 |
| 2013/0247078 | A1* | 9/2013 | Nikankin | H04N 21/44204 725/13 |
| 2014/0101689 | A1* | 4/2014 | Roberts et al. | 725/18 |

* cited by examiner

USING EMOTICONS FOR CONTEXTUAL TEXT-TO-SPEECH EXPRESSIVITY

BACKGROUND

The present disclosure relates to text-to-speech systems.

Text-to-speech processing is also known as speech synthesis, that is, the artificial production of human speech from a text source. Text-to-speech conversion is a complex process that converts a stream of written text into an audio output file or audio signal. There are many conventional text-to-speech (TTS) programs that convert text to audio. Conventional TTS algorithms typically function by trying to understand the composition of the text that is to be converted. Example techniques can split text into phonemes, splitting phrases within a line of text, digitizing speech, and so forth.

TTS processing capability is useful for visually impaired computer users that have difficulty interpreting visually displayed content and for users of mobile and embedded computing devices, where the mobile and embedded computing devices may either lack a screen, possess a tiny screen unsuitable for displaying large amounts of content, or can be used in an environment where it is not appropriate for a user to visually focus upon a display. Such an inappropriate environment can include, for example, a vehicle navigation environment, where outputting navigation information to a display for viewing can be distracting to a driver. Thus, TTS systems provide a convenient way to listen to text-based communications.

SUMMARY

One challenge in converting text-to-speech is accurately conveying emotion or audible expressivity. Conventional TTS systems are limited to analyzing punctuation and word arrangement in an attempt to guess at a possible mood of a text block to add some type of inflection, speech/pitch change, pause, etc. Such attempts at introducing inflection from approximated natural language understanding can be at times close, or just as easily completely miss the mark. Generally it is difficult determine mood from mere language analysis because the actual mood of a composer can vary dramatically even when using identical text.

Accordingly, techniques disclosed herein include systems and methods that improve audible emotion characteristics when synthesizing speech from a text source. Specifically, techniques disclosed herein use emoticons as a basis for providing contextual text-to-speech expressivity. Emoticons are common in text messages and chat messages, and their presence often indicates a sender's mood or attitude when composing the text. With the system herein, when a given emoticon has been identified in a given character string or block of text, a text-to-speech (TTS) engine makes use of the identified emoticon to enhance expressivity of the audio read out. For example, a common emoticon is known as a "smiley face," which is conventionally formed using a colon immediately followed by a right parenthesis ":)" or, alternatively, a colon immediately followed by a hyphen and then immediately followed by a right parenthesis ":-)." Sometimes applications graphically convert this combination of punctuation marks to a drawing of a smiley face.

With techniques disclosed herein, when a smiley face emoticon is included in a text message, then the TTS engine can read out the text in a more cheerful or upbeat manner. Likewise, if the system identifies an angry emoticon, then the TTS engine can make use of this information to change a read out tone to match an angry mood of a respective message. Changing the expressivity through emoticon-based contextual cues allows for an enhanced audio experience and the perception of a more intelligent and advanced TTS system. The expressivity of the TTS engine can include, but is not limited to, changes in intonation, prosody, speed, pauses and other features.

One embodiment includes an expressivity manager of a software application and/or hardware device. The expressivity manager receives a character string, such as a text message or other unit of text. The expressivity manager identifies one or more emoticons within the character string, such as an emoticon at the end of a particular sentence. The expressivity manager tags the character string with an expressivity tag that indicates expressivity corresponding to the emoticon. Then the expressivity manager converts the character string into an audible signal or audio output file using a text-to-speech module or engine, such that audible expressivity of the audible signal is based on data from the expressivity tag, that is audible expressivity is driven by a particular type of identified emoticon.

Conventionally, TTS engines, when encountering emoticons, typically either ignore the emoticon or speak the name of the emoticon, such as literally speaking "smiley face" or "angry face" or even speaking the name of the punctuation combination such as "colon right parenthesis." Emoticons are useful for disambiguating emotion or mood of textual content, which otherwise might be difficult to identify just from a textual analysis alone. Emoticons are helpful to a reader to mentally recreate a sound representative of how a sender would speak corresponding text. Emoticons thus have an immediate emotional tie-in to text, and thus driving text-to-speech expressivity using information from emoticons can provide an accurate enhancement to text read out.

Yet other embodiments herein include software programs to perform the steps and operations summarized above and disclosed in detail below. One such embodiment comprises a computer program product that has a computer-storage medium (e.g., a non-transitory, tangible, computer-readable medium, disparately located or commonly located storage media, computer storage media or medium, etc.) including computer program logic encoded thereon that, when performed in a computerized device having a processor and corresponding memory, programs the processor to perform (or causes the processor to perform) the operations disclosed herein. Such arrangements are typically provided as software, firmware, microcode, code data (e.g., data structures), etc., arranged or encoded on a computer readable storage medium such as an optical medium (e.g., CD-ROM), floppy disk, hard disk, one or more ROM or RAM or PROM chips, an Application Specific Integrated Circuit (ASIC), a field-programmable gate array (FPGA), and so on. The software or firmware or other such configurations can be installed onto a computerized device to cause the computerized device to perform the techniques explained herein.

Accordingly, one particular embodiment of the present disclosure is directed to a computer program product that includes one or more non-transitory computer storage media having instructions stored thereon for supporting operations such as: receiving a character string; identifying an emoticon within the character string; tagging the character string with an expressivity tag that indicates expressivity corresponding to the emoticon; and converting the character string into an audible signal using a text-to-speech module, such that audible expressivity of the audible signal is based on data from the expressivity tag. The instructions, and method as described herein, when carried out by a processor of a respective computer device, cause the processor to perform the methods disclosed herein.

Other embodiments of the present disclosure include software programs to perform any of the method embodiment steps and operations summarized above and disclosed in detail below.

Of course, the order of discussion of the different steps as described herein has been presented for clarity sake. In general, these steps can be performed in any suitable order.

Also, it is to be understood that each of the systems, methods, apparatuses, etc. herein can be embodied strictly as a software program, as a hybrid of software and hardware, or as hardware alone such as within a processor, or within an operating system or within a software application, or via a non-software application such a person performing all or part of the operations.

As discussed above, techniques herein are well suited for use in software applications supporting speech synthesis and text-to-speech functionality. It should be noted, however, that embodiments herein are not limited to use in such applications and that the techniques discussed herein are well suited for other applications as well.

Additionally, although each of the different features, techniques, configurations, etc. herein may be discussed in different places of this disclosure, it is intended that each of the concepts can be executed independently of each other or in combination with each other. Accordingly, the present invention can be embodied and viewed in many different ways.

Note that this summary section herein does not specify every embodiment and/or incrementally novel aspect of the present disclosure or claimed invention. Instead, this summary only provides a preliminary discussion of different embodiments and corresponding points of novelty over conventional techniques. For additional details and/or possible perspectives of the invention and embodiments, the reader is directed to the Detailed Description section and corresponding figures of the present disclosure as further discussed below.

BRIEF DESCRIPTION OF THE DRAWINGS

The foregoing and other objects, features, and advantages of the invention will be apparent from the following more particular description of preferred embodiments herein as illustrated in the accompanying drawings in which like reference characters refer to the same parts throughout the different views. The drawings are not necessarily to scale, with emphasis instead being placed upon illustrating the embodiments, principles and concepts.

DETAILED DESCRIPTION

Techniques disclosed herein include systems and methods that improve audible representation of emotion when synthesizing speech from a text source. Specifically, techniques disclosed herein use emoticons to provide contextual text-to-speech expressivity. In general, techniques herein analyze text received at (or accessed by) a text-to-speech engine. The system parses out emoticons (and can also identify punctuation) and uses identified emoticons to form expressivity of the text read out, that is machine-generated speech. For example, if the system identifies a smiley face emoticon at the end of a sentence, then the system can infer that this sentence—and possibly a subsequent sentence—has a tone or mood associated with it. Depending on whether the emoticon is a smiley face, angry face, sad face, laughing face, etc., the system can infer use or mood from the various emoticons and then change or modify the expressivity of the TTS output. Expressivity of the TTS system, and modifications to it, can include several changes. For example, a speech pitch can be modified between high and low, a read speed can be slowed or accelerated, certain words can be emphasized, and other audible characteristics such as intonation, prosody. This includes essentially any changes to the audible read out of text that can reflect or represent one or more given emotions.

Emoticons are common in text messages, and their presence often indicates a sender's mood or attitude. When a given emoticon has been identified in a given character string or block of text, a text-to-speech (TTS) engine makes use of the identified emoticon to enhance expressivity of the audio read out. For example, a common emoticon is known as a "smiley face," which is conventionally formed using a colon immediately followed by a right parenthesis ":)" or, alternatively, a colon immediately followed by a hyphen and then immediately followed by a right parenthesis ":-)." Sometimes applications graphically convert this combination of punctuation marks to a drawing of a smiley face.

Figure 1A:
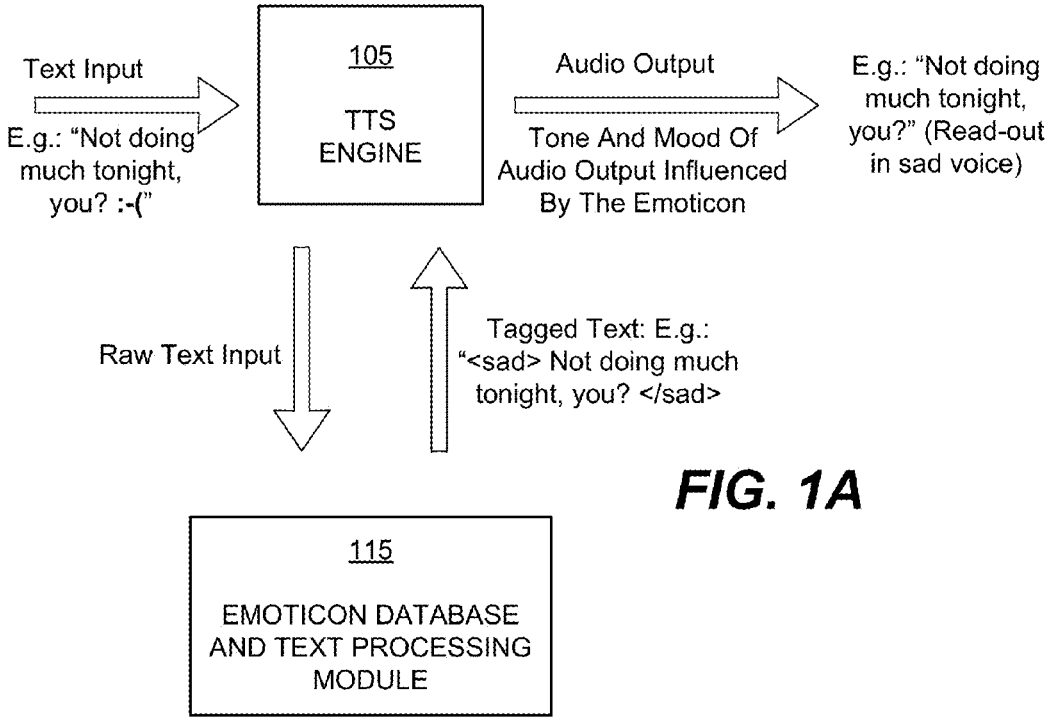
FIG. 1A is a block diagram of a system supporting contextual text-to-speech expressivity functionality according to embodiments herein.

Referring now to FIG. 1A, a block diagram shows how TTS engine 105 processes text that includes one or more emoticons. TTS engine 105 receives a text input, which can be any character string. The example input received is: "Not doing much tonight, you? :-(." In this input a person indicates a personal plan for the evening as well as a question, and then includes a sad face emoticon. This raw text input is then fed to emoticon database and text processing module 115. The emoticon database can include a mapping of emoticons and mood tags. For example, ":)" ":-)" and ";)" can all map to a "happy" mood tag. A happy mood tag can then cause one or more modifications to read out expressivity, such as increasing pitch, tone, speed, rhythm, stress, etc. Similarly, emoticons ":(" and ":-(" can map to a "sad" mood tag, which can cause corresponding changes in expressivity to match peoples speech patterns when speaking about something sad. The emoticon ">:)" can map to a "surprised" mood tag and cause expressivity changes that minor surprise in natural human speech. Note that there are many emoticons and combinations of emoticons that can be included in the emoticon database for mapping to other mood tags such as "sarcastic" "mixed feelings" "nervous," etc.

In the FIG. 1A example, the emoticon database and text processing module 115 returns tagged text—indicating a sad mood—to TTS engine 105. TTS engine 105 then continues with processing audio output with tone and/or mood of the audio output driven by the mood tag. In this example, the text is then read out with audible expressivity characteristic of speech conveying sadness. Had the emoticon example instead been a smiley face, then the mood tag could instruct the TTS engine to read the sentence in a little more upbeat style, perhaps a little faster with an intonation at the end.

Figure 1B:
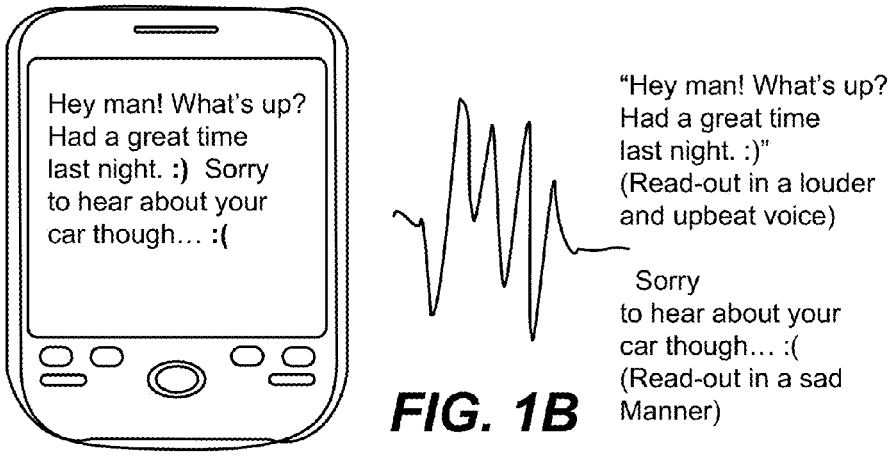
FIG. 1B is a representation of an example read out of a device supporting contextual text-to-speech expressivity functionality according to embodiments herein.

Modifying expressivity based on emoticons becomes more complex, however, as the number and type of emoticons used increases. FIG. 1B is an example text having multiple emoticons. FIG. 1B shows an example text message being read out from a mobile device. When encountering multiple emoticons, the system can respond by rendering different sections of input text in a different manner. These mood tags may be used as markup tags for input text such that their use would mimic the presence of the corresponding emoticons. The exact text that a tag is applied to can be determined via emoticon database and text processing module 115, which takes raw text as input, and then calculate boundaries of the text that is to be tagged. Emoticons can be used in conjunction with punctuation. For example, the text in the FIG. 1B example reads: "Hey man! What's up? Had a great time last night. :) Sorry to hear about your car though . . . :(." Thus in this example there are multiple emoticons and emphasis punctuation. In this example, exclamation point can be used to increase the volume of the TTS read out and/or level of a "happiness" mood that is applied to the audio output. Example mood tag text could appear as: "<loud-happy>Hey man! What's up? Had a great time last night. </loud-happy> <sad> Sorry to hear about your car though . . . </sad>." Such tagging can cause the first three sentences to be read in a louder and upbeat voice, while the system reads the last sentence in a sad manner.

In other embodiments, the TTS system can identify confidence around a particular emoticon identified/tagged as part of the emoticon processing. This is especially useful for text bodies having more than one emoticon because each emoticon used can influence other emoticons. For example, a given text message reads: "I'm really excited to go the football game. :), but my best friend is not going to be able to attend. :(." With no confidence or intensity tags, the system might read the first sentence with intense happiness and then dramatically switch to intense sadness for the second sentence. Such an extreme mood flip would typically not happen in natural conversation. Thus, by assigning confidence levels and/or intensity levels to each mood tag, subsequent or surrounding emoticons can modify an initial confidence level and/or intensity level to either increase or decrease intensity. By way of a more specific example, in the example text message about the football game, there is a first instance of a smiley face emoticon, and then a subsequent instance of a sad face emoticon. In one processing example, the system tags the first sentence with a happy mood tag and a 50 percent intensity level. Then the system tags the second sentence with a sad mood tag and a 50 percent intensity level. Next, the system recognizes that two opposite mood tags are in close proximity to each other. In response, the system could then lower both intensity levels to perhaps 25 percent. The system can optionally include a separate tag that instructs a smooth transition between sentences. As a result, during read out, the first sentence can be read with a relatively slight increase in happiness expressivity, and then the second sentence is read with a relatively slight increase in sadness expressivity. In other words, the mood characteristics during read out are more subdued, which reflects mood of the sentence because the happiness of going to a football game is checked by not having a best friend at the game. This helps the tags define a more conversational and natural speech.

In other embodiments, the TTS system can also lower or increase expressivity based on a number of emoticons per characters of text. For example, if a given paragraph is scattered with emoticons of various moods, then a confidence level can be lowered, or an intensity level of expressivity can be lowered. Conversely, if a given block of text includes multiple emoticons that are all smiley faces, then the system can increase happiness expressivity because of increased confidence of a happy mood. Thus, emoticons can influence both a type of expressivity and an intensity level of expressivity.

The confidence evaluation can be simultaneous with mood tagging, or occur after initial tagging. In some embodiments, a decision engine or module can be used to make micro or macro decisions. For example, TTS expressivity can be modified based on an entire block of text, instead of merely a single sentence from a block of text. The system can make decisions on which phrases to influence, such as by using a sliding window of influence. For example, there may be an emoticon between two sentences. Does this emoticon influence the prior sentence, the subsequent sentence, or both? In some embodiments, this emoticon could be determined to influence the first sentence, and part of the second (subsequent) sentence, and then return to default speech expressivity.

Global analysis can help determine transitions and pauses to insert. Some pauses can be based on punctuation. Pauses, however, can be exaggerated. In some embodiments, the system aims to avoid extreme expression swings, such as going from exuberantly happy to miserably sad. For example, if one sentence has a smiley face and then a next sentence has a sad face, one modification response can be represented as extreme happiness to extreme sadness, but this may not be ideal. Alternatively, both the happiness and sadness (or anger) could be subdued. Such conflicting emoticons can affect a confidence level. For example, when exact opposite emoticons are identified close to each other, this may not result in a confidence level sufficient to modify default TTS read back.

There is local and global expressivity available, and both can be tagged. For example, local expressivity can be influenced by emoticons immediately surrounding or close to a given sentence or phrase of a character string. A global level of expressivity can be based on confidence about the mood of the speaker and/or number of emoticons, number of mood transitions, type of mood transitions, etc. For example, there could be a string of smiley faces, which could indicate a globally positive message. In contrast, there could be alternating smiley faces, angry faces, and sad faces through out a text sample, which mood swing could lower confidence because quickly switching expressivity among those emotions could result in the text reading seeming unnatural or extreme. Thus, in some embodiments an initial confidence level and/or intensity level is assigned, and then a corresponding passage is rescored after parsing an entire message or unit of text. In some embodiments, the global value can be a multiplier, which can normalize transitions. The global multiplier can also function to increase intensity. For example, if a given text message is identified as having nothing but smiley faces throughout, then the level of intensity for happy expressivity can be increased proportionately.

The TTS system can also incorporate information about the font. For example, bold, italics, and capitalized text can also increase or decrease corresponding intensity levels and/or support confidence levels.

Note that as used herein, "emoticon" refers to any combination of punctuation marks and/or characters appearing in a character or text string used to express a person's mood. This can include pictorial representations of facial expressions. Emoticon also includes graphics or images within text used to convey tone or mood, such as emoji or other picture characters or pictograms. The system can update mood tags as new emoticons are introduced. Conventionally there are numerous emoticons, and some of these can be ambiguous or add nothing to change mood. Thus, optionally, specific emoticons can be ignored or grouped with similar emoticons represented by a single mood tag. Certain TTS systems can include advanced expressivity such as different types of audible happiness, laughs, sadness, and so forth. In other words, there can be more than one way to vary a certain type of expressivity on specific TTS systems (apart from simply increasing or decreasing speed or intensity. TTS systems disclosed herein can maintain mood tags for the various subclasses of moods available for read out.

Figure 5:
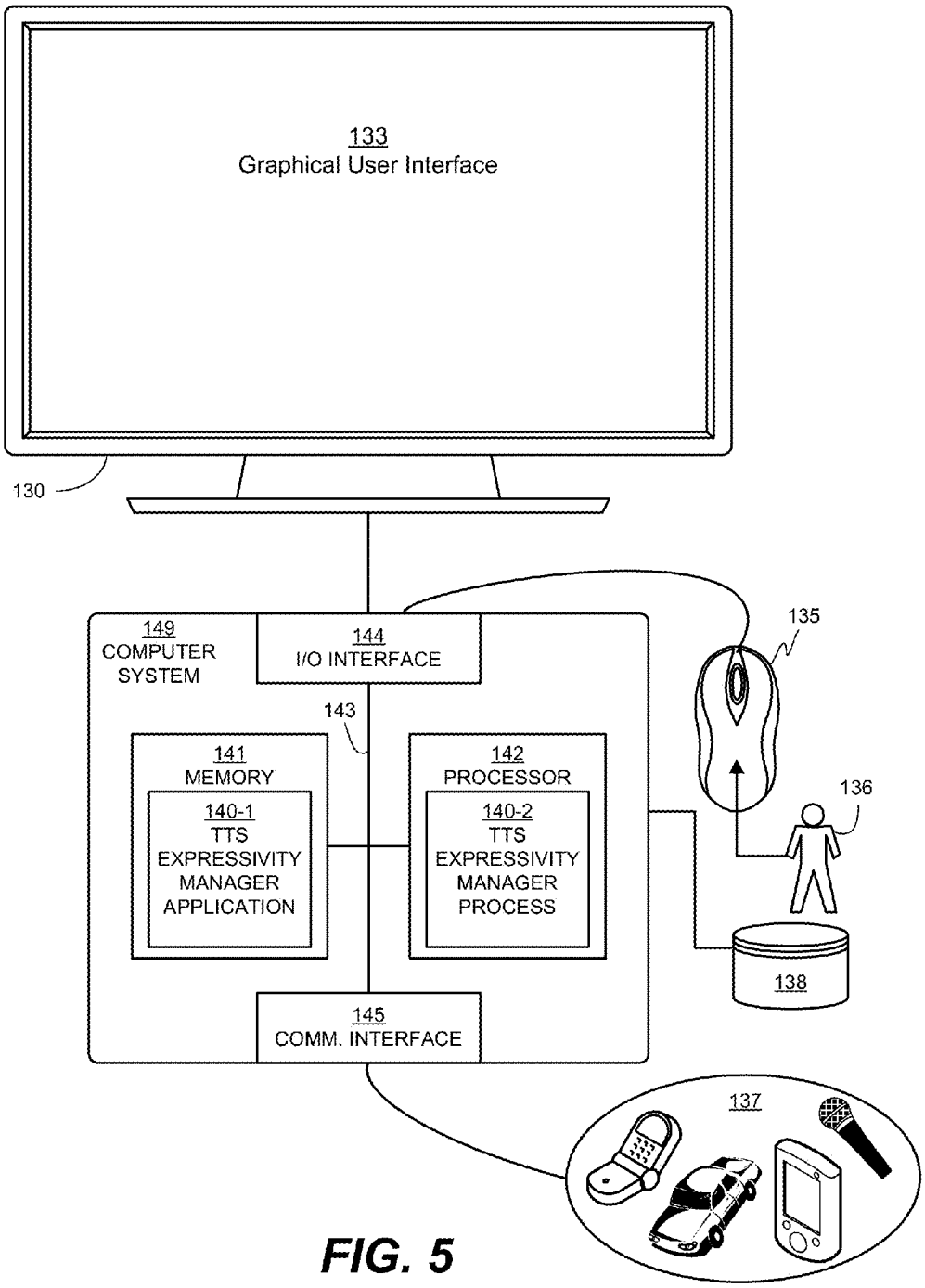
FIG. 5 is an example block diagram of an expressivity manager operating in a computer/network environment according to embodiments herein.

FIG. 5 illustrates an example block diagram of TTS expressivity manager 140 operating in a computer/network environment according to embodiments herein. Computer system hardware aspects of FIG. 5 will be described in more detail following a description of the flow charts.

Functionality associated with TTS expressivity manager 140 will now be discussed via flowcharts and diagrams in FIG. 2 through FIG. 4. For purposes of the following discussion, the TTS expressivity manager 140 or other appropriate entity performs steps in the flowcharts.

Figure 2:
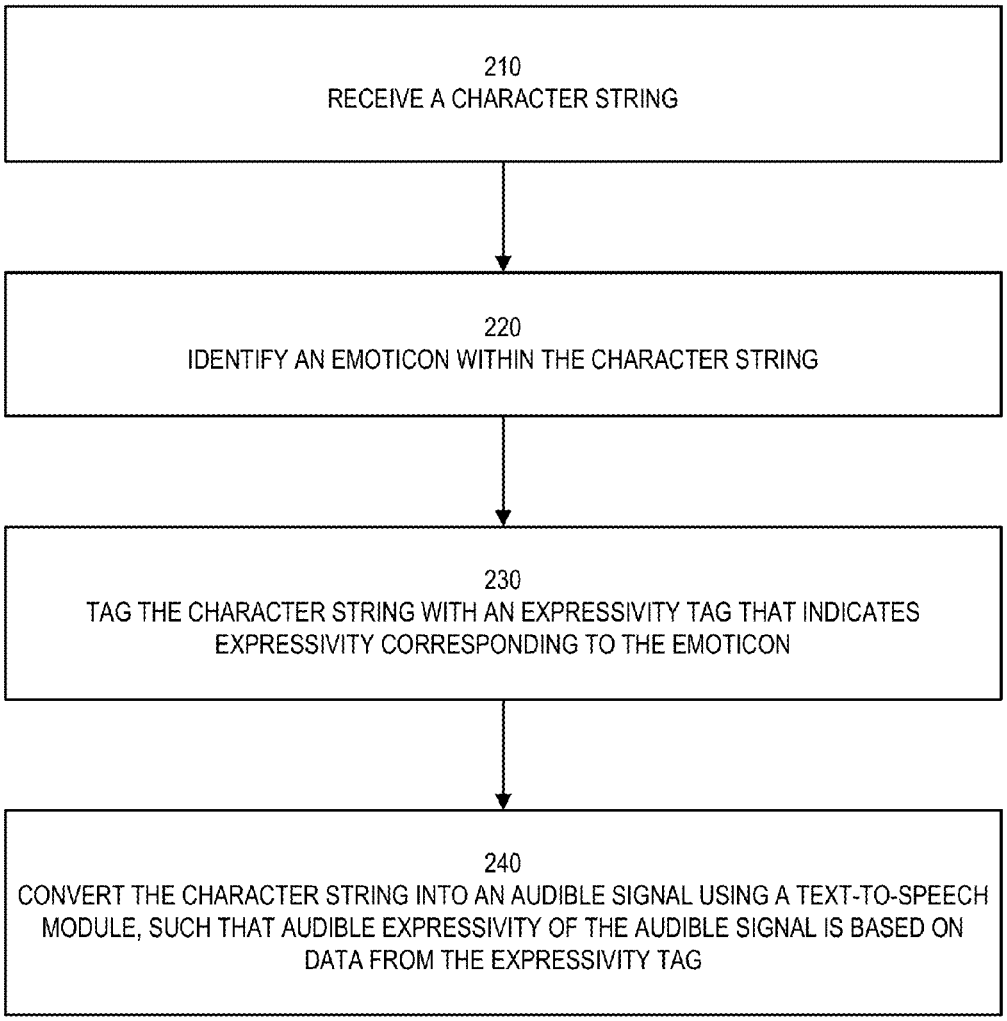
FIG. 2 is a flowchart illustrating an example of a process supporting contextual text-to-speech expressivity according to embodiments herein.

Now describing embodiments more specifically, FIG. 2 is a flow chart illustrating embodiments disclosed herein. In step 210, the TTS expressivity manager receives a character string. Such a character string can be a text message, email, written communication, etc.

In step 220, the TTS expressivity manager identifies an emoticon within the character string, such as by parsing the character string to recognize punctuation mark combinations or graphical characters such as emojis.

In step 230, the TTS expressivity manager tags the character string with an expressivity tag that indicates expressivity corresponding to the emoticon. For example, if the identified emoticon was a smiley face, then the corresponding expressivity tag would indicate a happy mood. Likewise, if the identified emoticon was an angry face, then the corresponding expressivity tag would indicate an angry mood for read out.

In step 240, the TTS expressivity manager converts the character string into an audible signal using a text-to-speech module, such that audible expressivity of the audible signal is based on data from the expressivity tag. In other words, when selecting or modifying a speed, pitch, intonation, prosody, etc. of a read out, the TTS system uses included mood tags to structure or change the expressivity. Note that the TTS system can use concatenated recorded speech (such as stringing together individual phonemes), purely machine-synthesized speech (computer voice), or otherwise.

Figure 3:
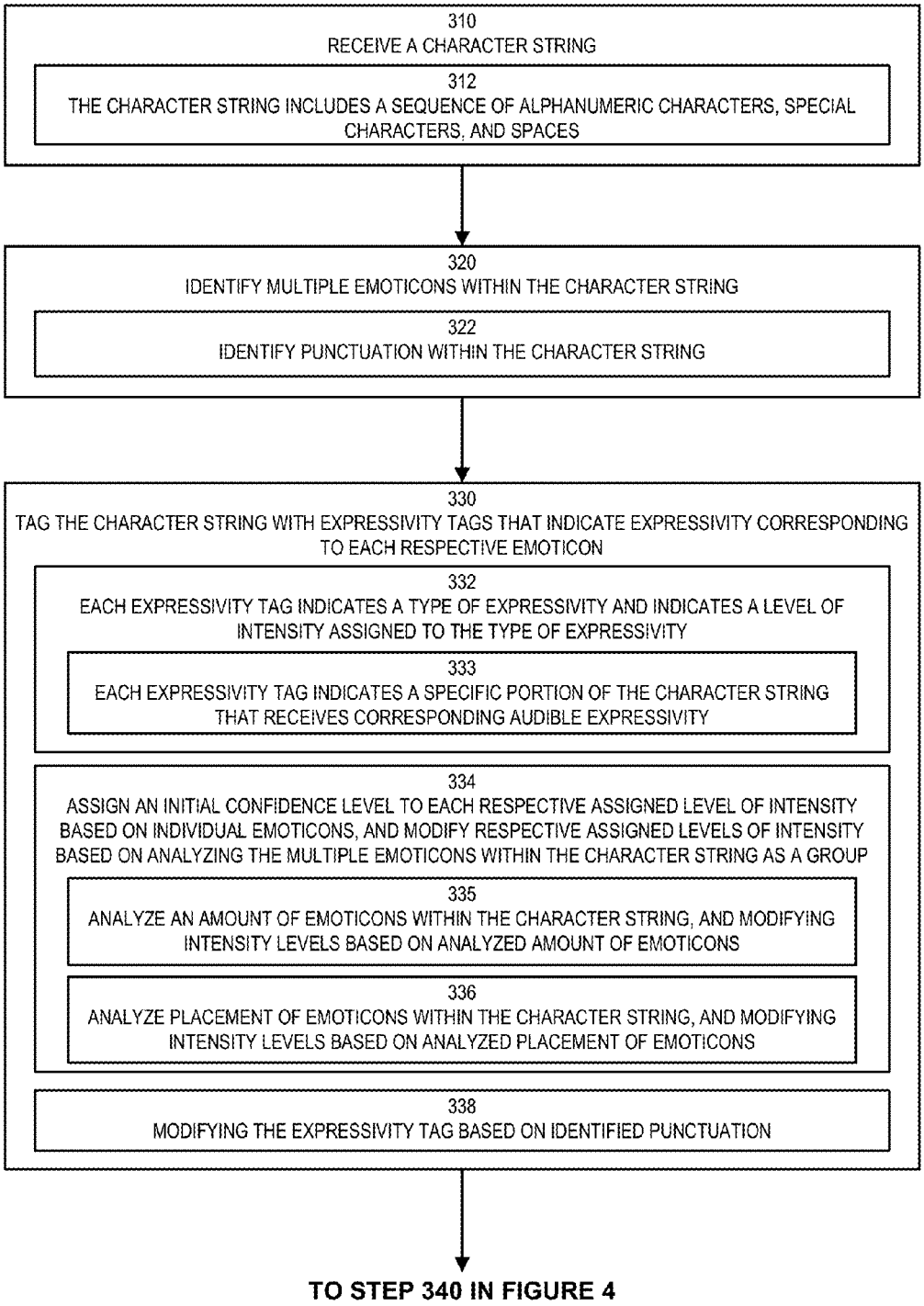
FIGS. 3-4 are a flowchart illustrating an example of a process supporting contextual text-to-speech expressivity according to embodiments herein.
Figure 4:
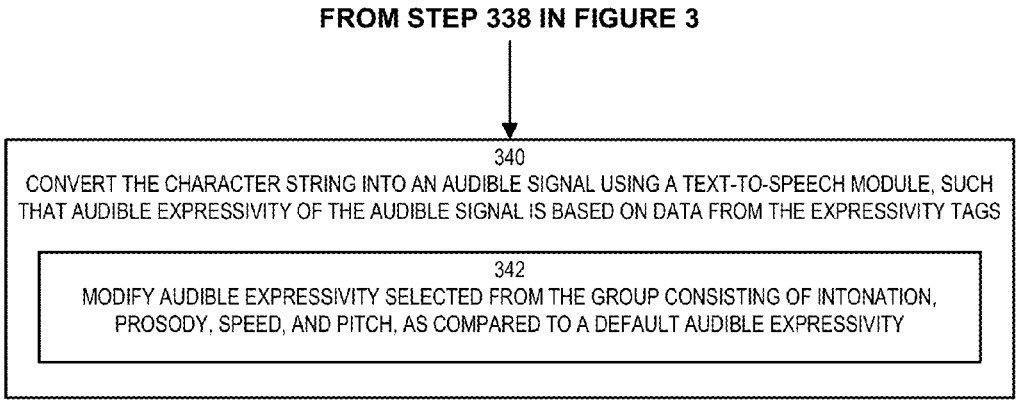

FIGS. 3-4 include a flow chart illustrating additional and/or alternative embodiments and optional functionality of the TTS expressivity manager 140 as disclosed herein.

In step 310, the TTS expressivity manager receives a character string, such as a sentence, statement, group of sentences, block of text, or any other unit of text that has at least one emoticon included.

In step 312, the character string includes a sequence of alphanumeric characters, special characters, and spaces.

In step 320, the TTS expressivity manager identifies multiple emoticons within the character string. Note that emoticons that appear at the end of a sentence or text block are still within or part of the character string, such as that composed and sent by another person.

In step 322, the TTS expressivity manager identifies punctuation within the character string, that is, non-emoticon punctuation such as periods, exclamation marks quotes, and so forth.

In step 330, the TTS expressivity manager tags the character string with expressivity tags that indicate expressivity corresponding to each respective emoticon. For example a mapping table can be used to determine which expressivity tags are used with which emoticons or emoticon combinations.

In step 332, each expressivity tag indicates a type of expressivity and indicates a level of intensity assigned to the type of expressivity. For example, a given expressivity tag might indicate that a type of expressivity is happiness or anger, and then also indicate how strong the happiness or anger should be conveyed. Any scoring system or scale can be used for the intensity level. The intensity level essentially serves to instruct whether the expressivity is going to be conveyed as subdued, moderate, bold, exaggerated, and so forth.

In step 333, each expressivity tag indicates a specific portion of the character string that receives corresponding audible expressivity. This can be accomplished either by specific placement of an expressivity tag, or range indicator. For example, in one embodiment, the expressivity tag can include a pair of tags or a two-part tag where a first tag indicates when a particular type of expressivity should begin, and when/where that particular type of expressivity should terminate. Alternatively, a single expressivity tag can be used that indicates a number of characters/words either before and/or after the expressivity tag that should be modified with the particular type of expressivity.

In step 334, the TTS expressivity manager assigns an initial confidence level to each respective assigned level of intensity based on individual emoticons, and modifies respective assigned levels of intensity based on analyzing the multiple emoticons within the character string as a group. Thus, the TTS expressivity manager can first execute local tagging based on each emoticon occurrence, and then revise/modify confidences and/or intensity levels after examining emoticons within the entire text corpus being analyzed.

In step 335, the TTS expressivity manager analyzes an amount of emoticons within the character string, and modifies intensity levels based on analyzed amounts of emoticons. For example, identifying many emoticons of a same type can increase a corresponding intensity, while identifying multiple emoticons of various types can result in decreasing intensity across various types of expressivity.

In step 336, the TTS expressivity manager analyzes placement of emoticons within the character string, and modifies intensity levels based on analyzed placement of emoticons. For example, if several emoticons appear only at the end of a unit of text, or only at the beginning of a unit of text, then expressivity can be increased or decreased at corresponding sections of the text, and left to a default expressivity at sections with no emoticons.

In step 338, the TTS expressivity manager modifies the expressivity tag based on identified punctuation, such as exclamation point placement. Such punctuation can serve to enhance or influence initial confidence and intensity assignments.

In step 340, the TTS expressivity manager converts the character string into an audible signal using a text-to-speech module, such that audible expressivity of the audible signal is based on data from the expressivity tags. In other words, a TTS system uses expressivity tags to drive expressivity selected for use during read out.

In step 342, the TTS expressivity manager modifies audible expressivity selected from the group consisting of intonation, prosody, speed, and pitch, as compared to a default audible expressivity.

Continuing with FIG. 5, the following discussion provides a basic embodiment indicating how to carry out functionality associated with the TTS expressivity manager 140 as discussed above. It should be noted, however, that the actual configuration for carrying out the TTS expressivity manager 140 can vary depending on a respective application. For example, computer system 149 can include one or multiple computers that carry out the processing as described herein.

In different embodiments, computer system 149 may be any of various types of devices, including, but not limited to, a cell phone, a personal computer system, desktop computer, laptop, notebook, or netbook computer, mainframe computer system, handheld computer, workstation, network computer, router, network switch, bridge, application server, storage device, a consumer electronics device such as a camera, camcorder, set top box, mobile device, video game console, handheld video game device, or in general any type of computing or electronic device.

Computer system 149 is shown connected to display monitor 130 for displaying a graphical user interface 133 for a user 136 to operate using input devices 135. Repository 138 can optionally be used for storing data files and content both before and after processing. Input devices 135 can include one or more devices such as a keyboard, computer mouse, microphone, etc.

As shown, computer system 149 of the present example includes an interconnect 143 that couples a memory system 141, a processor 142, I/O interface 144, and a communications interface 145, which can communicate with additional devices 137.

I/O interface 144 provides connectivity to peripheral devices such as input devices 135 including a computer mouse, a keyboard, a selection tool to move a cursor, display screen, etc.

Communications interface 145 enables the TTS expressivity manager 140 of computer system 149 to communicate over a network and, if necessary, retrieve any data required to create views, process content, communicate with a user, etc. according to embodiments herein.

As shown, memory system 141 is encoded with TTS expressivity manager 140-1 that supports functionality as discussed above and as discussed further below. TTS expressivity manager 140-1 (and/or other resources as described herein) can be embodied as software code such as data and/or logic instructions that support processing functionality according to different embodiments described herein.

During operation of one embodiment, processor 142 accesses memory system 141 via the use of interconnect 143 in order to launch, run, execute, interpret or otherwise perform the logic instructions of the TTS expressivity manager 140-1. Execution of the TTS expressivity manager 140-1 produces processing functionality in TTS expressivity manager process 140-2. In other words, the TTS expressivity manager process 140-2 represents one or more portions of the TTS expressivity manager 140 performing within or upon the processor 142 in the computer system 149.

It should be noted that, in addition to the TTS expressivity manager process 140-2 that carries out method operations as discussed herein, other embodiments herein include the TTS expressivity manager 140-1 itself (i.e., the un-executed or non-performing logic instructions and/or data). The TTS expressivity manager 140-1 may be stored on a non-transitory, tangible computer-readable storage medium including computer readable storage media such as floppy disk, hard disk, optical medium, etc. According to other embodiments, the TTS expressivity manager 140-1 can also be stored in a memory type system such as in firmware, read only memory (ROM), or, as in this example, as executable code within the memory system 141.

In addition to these embodiments, it should also be noted that other embodiments herein include the execution of the TTS expressivity manager 140-1 in processor 142 as the TTS expressivity manager process 140-2. Thus, those skilled in the art will understand that the computer system 149 can include other processes and/or software and hardware components, such as an operating system that controls allocation and use of hardware resources, or multiple processors.

Those skilled in the art will also understand that there can be many variations made to the operations of the techniques explained above while still achieving the same objectives of the invention. Such variations are intended to be covered by the scope of this invention. As such, the foregoing descriptions of embodiments of the invention are not intended to be limiting. Rather, any limitations to embodiments of the invention are presented in the following claims.

The invention claimed is:

1. A computer-implemented method comprising:

receiving, by a computing system, data comprising text, and a plurality of emoticons;

performing, by the computing system, a text-to-speech conversion of the data, wherein the text-to-speech conversion of the data further comprises:

determining, by the computing system, a local expressivity corresponding to a group of emoticons of the plurality of emoticons based on a calculation of boundaries of the text, wherein each emoticon of the group of emoticons is located in proximity to a phrase associated with the text within the boundaries that each emoticon is associated with and wherein the local expressivity is associated with a first audio intensity level;

determining, by the computing system, a global expressivity for the data, wherein the global expressivity corresponds to a global multiplier determined after parsing an entire text without the boundaries and the global multiplier modifies the first audio intensity level;

determining, by the computing system, a second audio intensity level associated with the global expressivity; and generating, by the computing system and based on the modified first audio intensity level and the second audio intensity level, an audible signal representative of the text-to-speech conversion of the data.

2. The computer-implemented method of claim 1, further comprising:

determining a respective mood corresponding to each emoticon of the plurality of emoticons;

determining, by the computing system and based on the respective mood corresponding to each emoticon of the plurality of emoticons, one or more confidence levels associated with the group of emoticons; and modifying, based on the one or more confidence levels, the global multiplier.

3. The computer-implemented method of claim 1, further comprising:

determining, based on the modified first audio intensity level, an audible expressivity tag for the group of emoticons, and modifying the audible expressivity tag based on identifying a font associated with the phrase.

4. The computer-implemented method of claim 1, further comprising:

determining, by the computing system, a mood transition based on a first emoticon of the plurality of emoticons being in close proximity to a second emoticon of the plurality of emoticons; and determining, by the computing system, a mood transition tag that is configured to smooth the mood transition by changing an intensity of the audible signal during the text-to-speech conversion of the data corresponding to the first emoticon of the plurality of emoticons and the second emoticon of the plurality of emoticons.

5. The computer-implemented method of claim 1, further comprising:

receiving, by the computing system and from a user device, a user input indicating a user-selected portion of the data, wherein the user input is based on a sliding window option, displayable by the user device, for delimiting the portion of the data;

determining, by the computing system, a number of mood transitions associated with a plurality of moods corresponding to the portion of the data; and determining, by the computing system, a confidence level for each mood of the plurality of moods and an intensity level for each mood of the plurality of moods.

6. The computer-implemented method of claim 5, further comprising:

modifying, by the computing system, the global multiplier based on the confidence level for each mood of the plurality of moods and the intensity level for each mood of the plurality of moods and further based on the number of mood transitions; and performing, by the computing system, the text-to-speech conversion of the data based on the modified global multiplier.

7. The computer-implemented method of claim 1, wherein the determining the second audio intensity level is based on a global analysis of the data, and wherein the global analysis of the data further comprises:

determining, by the computing system, one or more pauses associated with the data based on an identification of one or more punctuations in the data, the one or more pauses being configured to change a confidence level associated with an emoticon of the plurality of emoticons.

8. A system comprising:

at least one processor; and a memory storing instructions that when executed by the at least one processor cause the system to convert text to speech by configuring the system to:

receive data comprising text and a plurality of emoticons;

determine a local expressivity corresponding to a group of emoticons of the plurality of emoticons based on a calculation of boundaries of the text, wherein the group of emoticons is located in proximity to a phrase of the text within the boundaries;

determine, based on the local expressivity, a first audio intensity level;

determine a global expressivity for the data, wherein the global expressivity corresponds to a global multiplier determined after parsing an entire text without the boundaries and the global multiplier modifies the first audio intensity level;

determine a second audio intensity level associated with the global expressivity; and generate, based on the modified first audio intensity level and the second audio intensity level, an audible signal representing a text-to-speech conversion of the data.

9. The system of claim 8, wherein the instructions, when executed by the at least one processor, further cause the system to:

determine, a first confidence level for a mood associated with the data and a first intensity level for the mood; and determine, based on the first confidence level and based on the first intensity level, a second intensity level associated with the mood that is configured to alter the global expressivity.

10. The system of claim 8, wherein the instructions, when executed by the at least one processor, cause the system to:

determine, based on the modified first audio intensity level, an audible expressivity tag for the group of emoticons; and modify the audible expressivity tag based on identifying a font associated with the phrase.

11. The system of claim 8, wherein the instructions, when executed by the at least one processor, cause the system to:

determine a mood transition based on a first emoticon of the plurality of emoticons being in close proximity to a second emoticon of the plurality of emoticons; and determine, a mood transition tag that is configured to smooth the mood transition by changing an intensity of the audible signal during the text-to-speech conversion of the data corresponding to the first emoticon of the plurality of emoticons and the second emoticon of the plurality of emoticons.

12. The system of claim 8, wherein the instructions, when executed by the at least one processor, cause the system to:

receive, from a user device, a user input indicative of a user-selected portion of the data, wherein the user input is based on a sliding window option, displayable by the user device, for delimiting the portion of the data;

determine a number of mood transitions associated with a plurality of moods corresponding to the portion of the data; and determine a confidence level for each mood of the plurality of moods and an intensity level for each mood of the plurality of moods, based on a global analysis of the portion of the data, the confidence level and the intensity level for each mood of the plurality of moods being configured to alter the second audio intensity level associated with the global expressivity.

13. The system of claim 12, wherein the instructions, when executed by the at least one processor, cause the system to:

determine a mood associated with each emoticon of the plurality of emoticons;

modify the global multiplier based on the confidence level for each mood of the plurality of moods and the intensity level for each mood of the plurality of moods and further based on the number of mood transitions; and perform the text-to-speech conversion of the data based on the modified global multiplier.

14. The system of claim 8, wherein the instructions, when executed by the at least one processor, cause the system to:

determine one or more pauses associated with the data based on an identification of one or more punctuations in the data, the one or more pauses being configured to modify a confidence level associated with an emoticon of the plurality of emoticons; and determine the second audio intensity level based on the modified confidence level.

15. One or more non-transitory computer-readable media having instructions stored thereon that when executed by one or more computers cause the one or more computers to convert text to speech by configuring the one or more computers to:

receive data comprising text and a plurality of emoticons;

determine a local expressivity corresponding to a group of emoticons of the plurality of emoticons based on a calculation of boundaries of the text, wherein each emoticon of the group of emoticons is located in proximity to a phrase of the text within the boundaries;

determine, based on the local expressivity, a first audio intensity level;

determine a global expressivity for the data, wherein the global expressivity corresponds to a global multiplier determined after parsing an entire text without the boundaries and the global multiplier modifies the first audio intensity level;

determine a second audio intensity level associated with the global expressivity; and generate, based on the modified first audio intensity level and the second audio intensity level, an audible signal representative of text-to-speech conversion of the data.

16. The one or more non-transitory computer-readable media of claim 15, wherein the instructions, when executed by the one or more computers, cause the one or more computers to:

determine a confidence level for a respective mood associated with each emoticon of the plurality of emoticons and an intensity level for the respective mood; and modify, based on the confidence level and the intensity level, the global multiplier.

17. The one or more non-transitory computer-readable media of claim 15, wherein the instructions, when executed by the one or more computers, cause the one or more computers to update an audible expressivity tag associated with the first audio intensity level based on identifying a font associated with the phrase.

18. The one or more non-transitory computer-readable media of claim 15, wherein the instructions, when executed by the one or more computers, cause the one or more computers to:

generate a first mood tag corresponding to a first emoticon of the plurality of emoticons and a second mood tag corresponding to a second emoticon of the plurality of emoticons;

determine a mood transition corresponding to the first mood tag and based on the first emoticon of the plurality of emoticons being in close proximity to the second emoticon of the plurality of emoticons; and determine, a mood transition tag associated with the mood transition configured to smooth the mood transition by changing an intensity of the audible signal during the text-to-speech conversion of the data.

19. The one or more non-transitory computer-readable media of claim 15, wherein the instructions, when executed by the one or more computers, cause the one or more computers to:

receive, from a user device, a user input indicating a user-selected portion of the data, wherein the user input is based on a sliding window option, displayable by the user device, for delimiting the portion of the data;

determine a number of mood transitions associated with a plurality of moods corresponding to a portion of the data; and determine a confidence level for each mood of the plurality of moods and an intensity level for each mood of the plurality of moods, based on a global analysis of the portion of the data, the confidence level and the intensity level for each mood of the plurality of moods being configured to alter the second audio intensity level.

20. The one or more non-transitory computer-readable media of claim 15, wherein the instructions, when executed by the one or more computers, cause the one or more computers to:

determine a mood associated with each emoticon of the plurality of emoticons;

determine at least one confidence level and at least one intensity level associated with the mood; and modify the global multiplier based on the at least one confidence level for the mood and the at least one intensity level for the mood.

* * * * *